United States Patent [19]

Shimomura et al.

[11] Patent Number: 4,869,223

[45] Date of Patent: Sep. 26, 1989

[54] FUEL CONTROL APPARATUS

[75] Inventors: Setsuhiro Shimomura; Yukinobu Nishimura, both of Himeji, Japan

[73] Assignee: Mitsubishi Denki Kabushiki Kaisha, Tokyo, Japan

[21] Appl. No.: 244,275

[22] Filed: Sep. 14, 1988

[30] Foreign Application Priority Data

Oct. 9, 1987 [JP] Japan ..... 62-255361

[51] Int. Cl.[4] ..... F02M 51/00

[52] U.S. Cl. ..... 123/489; 123/494

[58] Field of Search ..... 123/489, 494, 440, 478, 123/490, 480, 491, 486

[56] References Cited

U.S. PATENT DOCUMENTS

| | | | |
|---|---|---|---|
| 4,334,186 | 6/1982 | Sasayawa et al. | 123/494 |
| 4,397,283 | 8/1983 | Komaroff et al. | 123/494 |
| 4,741,313 | 5/1988 | Shimomura | 123/494 |
| 4,751,907 | 6/1988 | Yamamoto et al. | 123/489 |
| 4,766,868 | 8/1988 | Shibata | 123/489 |
| 4,771,753 | 9/1988 | Ohishi | 123/489 |
| 4,817,573 | 4/1984 | Yamada et al. | 123/489 |

*Primary Examiner*—Raymond A. Nelli
*Attorney, Agent, or Firm*—Sughrue, Mion, Zinn, Macpeak and Seas

[57] ABSTRACT

Signals from a intake air quantity sensor disposed in the intake air passage of an internal combustion engine are calculated to obtain a basic value corresponding to an amount of fuel required for the engine; the basic value is corrected by a negative feed-back control on the basis of the output of an air-fuel ratio sensor so as to obtain a desired air-fuel ratio to thereby supply the fuel to the engine by controlling a fuel control valve. A fuel control device comprises a writing means for writing in a memory a value of negative feed-back correction or a value related thereto when the output of the intake air quantity sensor is in the vicinity of a representative point, a correcting means for correcting the basic value on the basis of data in the memory and a valve controlling means to close a control valve which controls feeding of vaporized fuel caught in a canister to the air intake system of the engine when the value of negative feed-back corection or the value related thereto is written in the memory.

5 Claims, 4 Drawing Sheets

11: Crank angle sensor
12: Starting switch

11: Crank angle sensor
12: Starting switch

11: Crank angle sensor
12: Starting switch
4: $O_2$ sensor
13: Water temperature sensor
101: digital interface
102: Analogue interface
104: A/D transducer
106: Driving circuit
107: Driving circuit

FUEL CONTROL APPARATUS

BACKGROUND OF THE INVENTION

1. Field of the Invention

The present invention relates to a fuel control apparatus having an intake air quantity sensor used for controlling fuel supplied to an internal combustion engine. More particularly, it relates to a fuel control apparatus which permits a correction in response to a change with time in a hot wire type intake air quantity sensor.

2. Discussion of Background

The characteristic of the hot wire type intake air quantity sensor is changed by materials deposited on the surface of a hot wire, whereby there is caused an error in an amount of fuel supplied to the engine. As a result, the problems of deterioration of exhaust gas and reduction in operational performance are invited.

There is the same problem in a vane type intake air quantity sensor due to a change of characteristic depending on materials deposited on its sliding part. The change of characteristic caused by the deposite affects a flow rate of intake air passing around the intake air quantity sensor. Correction of the change of characteristic may be made by a negative feed-back control by using an air-fuel ratio sensor. However, there is a case that the correction of the change of characteristic has to be made in a region where it is impossible to employ the negative feed-back control. For such specific case, there is known a method of learning and correction as shown in, for instance, Japanese Unexamined Pat. Publication No. 150057/1983. This publication discloses an apparatus for correcting an air-fuel ratio by negative-feeding-back of the output of an air-fuel ratio sensor provided in the exhaust pipe of an engine, wherein a value of negative feed-back is stored in a memory so that a basic value for fuel control is corrected in the region other than a negative feed-back region on the basis of data stored in the memory.

In a case that a learning and correction method is carried out in a region (where a high flow rate is formed and an air-fuel ratio thicker than the theoretical air-fuel ratio is required) other than a negative feed-back region by estimating a value of correction at the region which allows correction of characteristic change of an intake air quantity sensor by the negative feed-back control, when there is caused temporarily an error in an air-fuel ratio peculiar to that region at the time of the correction by the negative feed-back control, a value obtained by the learning and correction by estimation becomes incorrect and it enhances an air-fuel ratio error in the high flow rate region. As such temporarily error, there is an air-fuel ratio error produced when vaporized full caught in a canister is purged into the intake air passage of the engine. The effect by purging the fuel is large when the engine is driven with a low load, i.e. when an amount of intake air is small. On the other hand, the effect is small when an amount of intake air is large. Accordingly, it is impossible to use the method of learning and correction by estimation unless the effect by the purging is removed.

SUMMARY OF THE INVENTION

It is an object of the present invention to provide a fuel control apparatus which provides a correct value by eliminating error in a value obtained by learning and correction caused by purging evaporated fuel to an engine and provides an excellent fuel control.

The foregoing and the other objects of the present invention have been attained by providing a fuel control apparatus which comprises a fuel supplying means for supplying fuel to an internal combustion engine in response to the operation of a fuel control valve, an intake air quantity sensor disposed in an air intake passage of the internal combustion engine to detect a quantity of intake air, an air-fuel ratio sensor attached to the exhaust pipe of the engine to produce an output in response to an air-fuel ratio and a fuel control means which receives the output of the intake air quantity sensor to calculate a basic value corresponding to an amount of fuel required for the engine, and corrects the basic value by a negative feed-back control on the basis of the output of the air-fuel ratio sensor so as to obtain a desired air-fuel ratio to thereby supply the fuel to the engine by controlling the fuel control valve, wherein the fuel control means comprises a writing means for writing in a memory a value of negative feed-back correction or a value related thereto when the output of the intake air quantity sensor is in the vicinity of a representative point, a correcting means for correcting the basis value on the basis of a data in the memory and a valve controlling means to close a control valve which controls feeding of vaporized fuel caught in a canister to the air intake system of the engine when the value of negative feed-back correction or the value related thereto is written in the memory.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
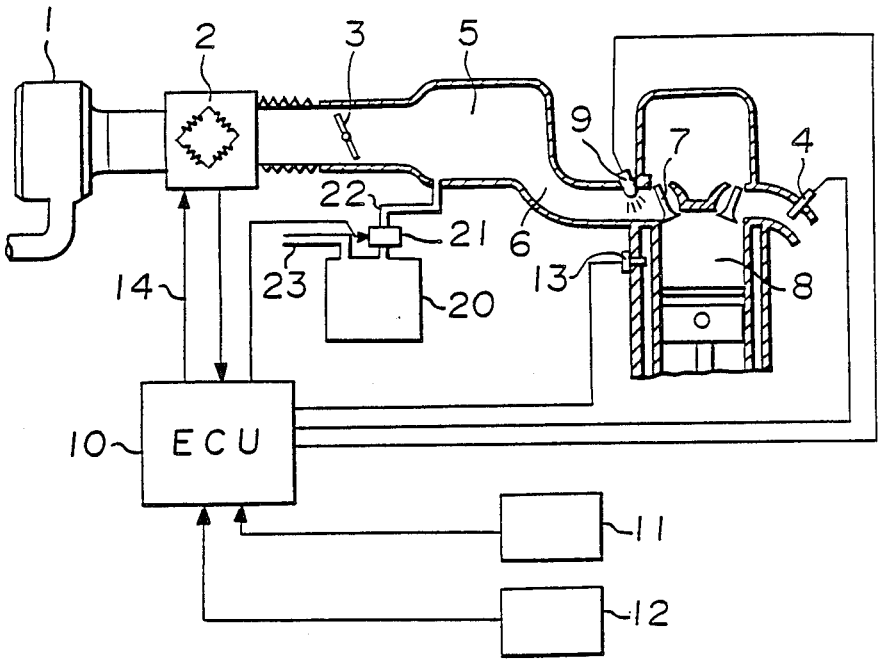
FIG. 1 is a block diagram of an embodiment of the fuel control apparatus according to the present invention.

Referring to the drawings, wherein the same reference numerals designate the same or corresponding parts throughout the several views, and more particularly to FIG. 1 thereof, there is shown a block diagram showing the construction of an embodiment of the fuel control apparatus in which a hot wire type intake air quantity sensor (hereinbelow, referred to as AFS) for detecting an amount of air sucked into an engine. In FIG. 1, a reference numeral 1 designates an air cleaner, a numeral 2 designates the above-mentioned AFS, and a numeral 3 designates a throttle valve for controlling an amount of air sucked to the engine.

An intake air manifold 6 is connected to a surge tank 5 and the manifold 6 is connected to cylinders 8, each provided with an air intake valve 7 operated by a crank (not shown). In FIG. 1, only one cylinder 8 is shown for simplification of the drawing although the engine comprises a plurality of the cylinders.

A fuel control valve 9 (hereinbelow, referred to as an injector) is provided on each of the cylinders 8. An electronically controlled unit 10 (hereinbelow, referred to as an ECU) controls an amount of fuel injected from each of the injectors at a predetermined air-fuel ratio (A/F) with respect to an amount of air sucked to each of the cylinders 8. A numeral 4 designates an 02 sensor used for an air-fuel ratio negative feed-back control.

The ECU 10 determines a fuel injection quantity on the basis of each signal from the AFS 2, a crank angle sensor 11, a starting switch 12, a temperature sensor 13 for detecting the temperature of cooling water for the engine and the $O_2$ sensor 4, and supplys a signal of fuel injection pulse having a pulse width corresponding to the fuel injection quantity to the injectors in synchronism with a signal from the crank angle sensor 11.

A reference numeral 20 designates a canister which catches vaporised fuel supplied from a fuel tank (not shown) through a conduit 23 so that the fuel is purged into the surge tank 5 through a conduit 22 and an electrically controlled valve 21 such as a solenoid valve controlled by the ECU 10.

Figure 2:
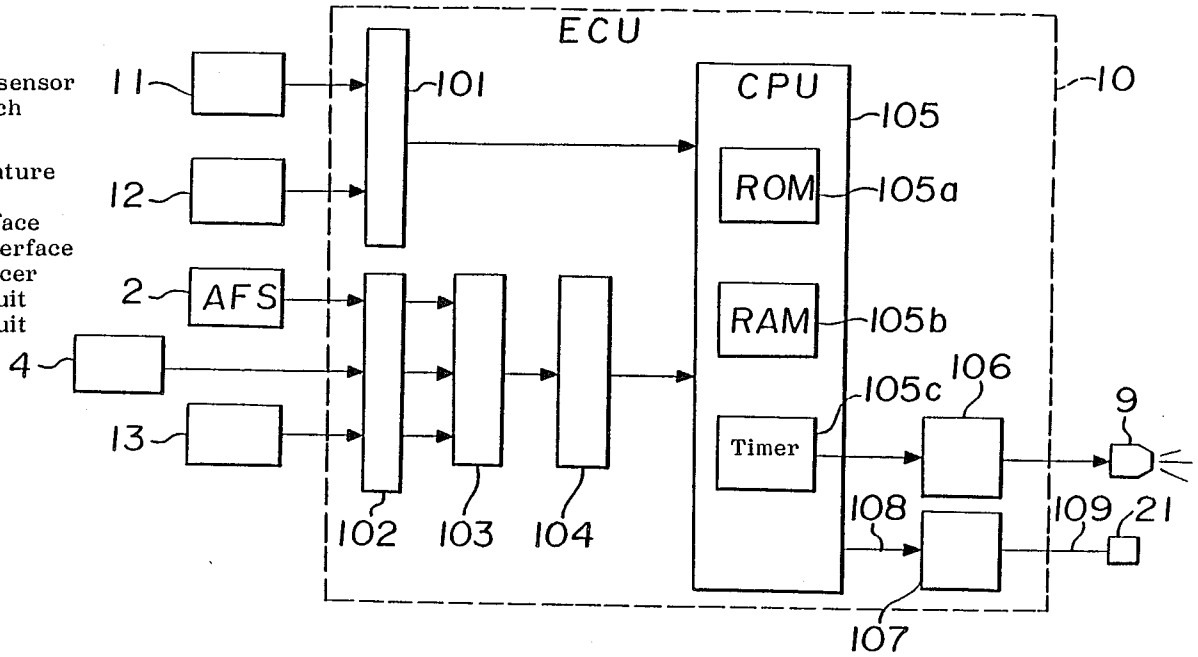
FIG. 2 is a block diagram showing an embodiment of the inner structure of an electrically controlled unit used for the fuel control apparatus shown in FIG. 1.

FIG. 2 is a block diagram showing the inner structure of the ECU 10. In FIG. 2, a reference numeral 101 designates an interface circuit of digital input type to receive signals from the crank angle sensor 11 and the starting switch 12, and a numeral 102 designates an interface circuit of analogue input type which receives signals from the AFS 2, the cooling water temperature sensor 13 and the 02 sensor 4.

A numeral 103 designates a multiplexer which receives the signals of the AFS 2, the cooling water temperature sensor 13 and the $O_2$ sensor 4. The output of the multiplexer 103 is supplied to an analogue/digital (A/D) transducer 104 in which analogue signals from the sensors are converted into digital values.

A central processing unit 105 (hereinbelow, referred to as a CPU) includes an ROM 105*a*, an RAM 105*b* and a timer 105*c*. The CPU calculates the pulse width of a signal for actuating the injectors 9 on the basis of signals from the interface circuit 101 and the A/D transducer 104 in accordance with a program stored in the ROM 105*a*, and outputs a pulse signal having a predetermined time width through the timer 105*c* triggered in synchronism with the crank angle sensor 11. The calculation of the pulse width is carried out as follows. The number of revolution of the engine N is calculated by measuring a period of the signal of the crank angle sensor 11 and an intake air flow rate Q is calculated by the output of the AFS 2. Then, a basic injection quantity, i.e. a basic value of fuel injection (Q/N) which corresponds to an intake air quantity per revolution is calculated by the number of revolution N and the intake air flow rate Q, and the basic injection quantity Q/N is corrected by an amount of correction calculated on the basis of the outputs of the water temperature sensor 13 and the $O_2$ sensor 4. Thus, the pulse width of the signal for fuel injection is determined.

The pulse signal is amplified by a driving circuit 106 by which the injectors 9 are actuated. The detailed description concerning control of fuel is omitted since the construction of the fuel control apparatus is known.

The CPU 105 receives the input signals indicating parameters of the engine to thereby output a signal 108 in accordance with an operational condition of the engine, whereby a driving circuit 107 is actuated so that the electrically controlled valve 21 is driven by an output 109 of the driving circuit 107.

Figure 3:
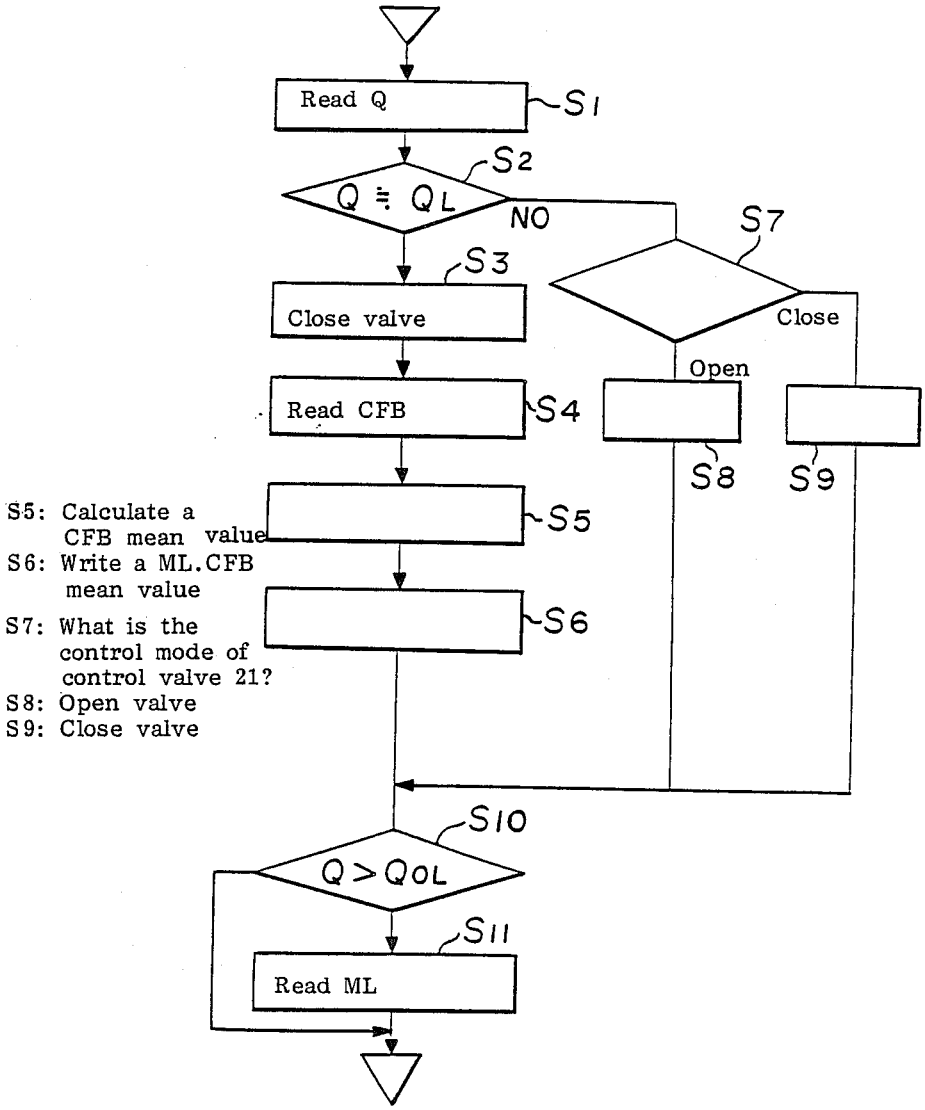
FIG. 3 is a flow chart showing an embodiment of a program for electrically controlled unit used for the fuel control apparatus of the present invention.

A method of calculating a value for correction will be described with reference to a flow chart of FIG. 3. FIG. 3 shows a flow of calculation which repeats each predetermined time in order to correct the change of characteristic of the intake air quantity sensor. A flow of fuel control and other flows are omitted.

In FIG. 3, at Step S1, the output Q of the intake air quantity sensor is read. At Step S2, the output Q is compared with a previously determined output value of the intake air quantity sensor, i.e. a representative value $Q_L$. Namely, determination is made as to whether or not the flow rate Q is substantially equal to the representative value $Q_L$. The representative value $Q_L$ is determined as a flow rate capable of representing the change of characteristic of the intake air quantity sensor.

FIG. 4*a* is a diagram showing the change of characteristic $\epsilon$, wherein the representative point $Q_L$ is so selected as to be a value slightly lower than a flow rate $O_{OL}$ which corresponds to the border line of using the negative feed-back correction as shown in FIG. 4*e*.

At Step S2, when the flow rate Q is substantially equal to the representative value $Q_L$, the electrically controlled valve 21 is closed to interrupt the purging of gas at Step S3. Then, an air-fuel ratio negative feed-back quantity CFB is read at the time of closing the valve 21 at Step S4.

The air-fuel ratio negative feed-back quantity CFB is a coefficient to effect a negative feed-back correction of the basic injection quantity so that an air-fuel ratio is brought to a target value by the $O_2$ sensor 4, and the coefficient corresponds to an output which has been subjected to proportion-integration treatments of an output obtained by comparing the output of the $O_2$ sensor 4 with a set value. Since this coefficient is known, the detailed description is omitted. As shown in FIG. 4*d*, the coefficient functions to cancel the change of characteristic s of the intake air quantity sensor 4.

Then, the value CFB read at Step S4 is subjected to calculation to obtain a mean value at Step S5, and thus obtained mean value $C_L$ is written in the memory $M_L$ at Step S6. As the operations to obtain the mean value, there are a method of obtaining an arithmetic mean value by processing at plural times values at points of change (the maximum and minimum points) of the air-fuel ratio feed-back quantity CFB subjected to proportioning and integrating processes, or a method of adding the arithmetic mean value multiplied by a weighted coefficient and a mean value in the data obtained before, the mean value being multiplied by a weighted coefficient. Since the air-fuel ratio feed-back quantity CFB is generally changed considerably depending on various factors in the engine, such as a change in the proportioning and integrating processes, there may occur erroneous corrections when instantaneous values of the quantity CFB are written in the memory as values for correction. Therefore, it is desirable to obtain the mean value of the quantity CFB. However, the air-fuel ratio negative feed-back quantity CFB can be directly written in the memory without obtaining the mean value.

For the memory for storing the mean value of the $C_L$ of the quantity CFB, it is preferable to use a non-volatile memory constituted by a battery-back-up RAM.

When the flow rate Q is not equal to the representative value $Q_L$ (i e. no learning mode) at Step S2, the judgement that mode for the electrically controlled valve 21 is at a control mode is made by a signal indicating a parameter of engine. For instance, the determination of "closing valve" is made when the controlling mode indicates an idling operation, and "closing valve" when the mode indicates other than the idling operation. When the judgement of "opening valve" is given, the electrically controlled valve 21 is opened at Step S8, and the valve 21 is closed at Step S9 when "closing valve" mode.

At Step S10, the flow rate Q is compared with a value $Q_{OL}$ when the flow rate Q is greater than the value $Q_{OL}$. When greater, it falls in a negative feed-back prohibiting region. In this case, data stored in the memory ML, i.e. a correction value $C_L$ is read at Step Sll so that the basic fuel injection quantity is corrected by the correction value. Such correction cancels the change of characteristic of the intake air quantity sensor for a component corresponding to the correction value CL to thereby provide an excellent fuel control.

Figure 4:
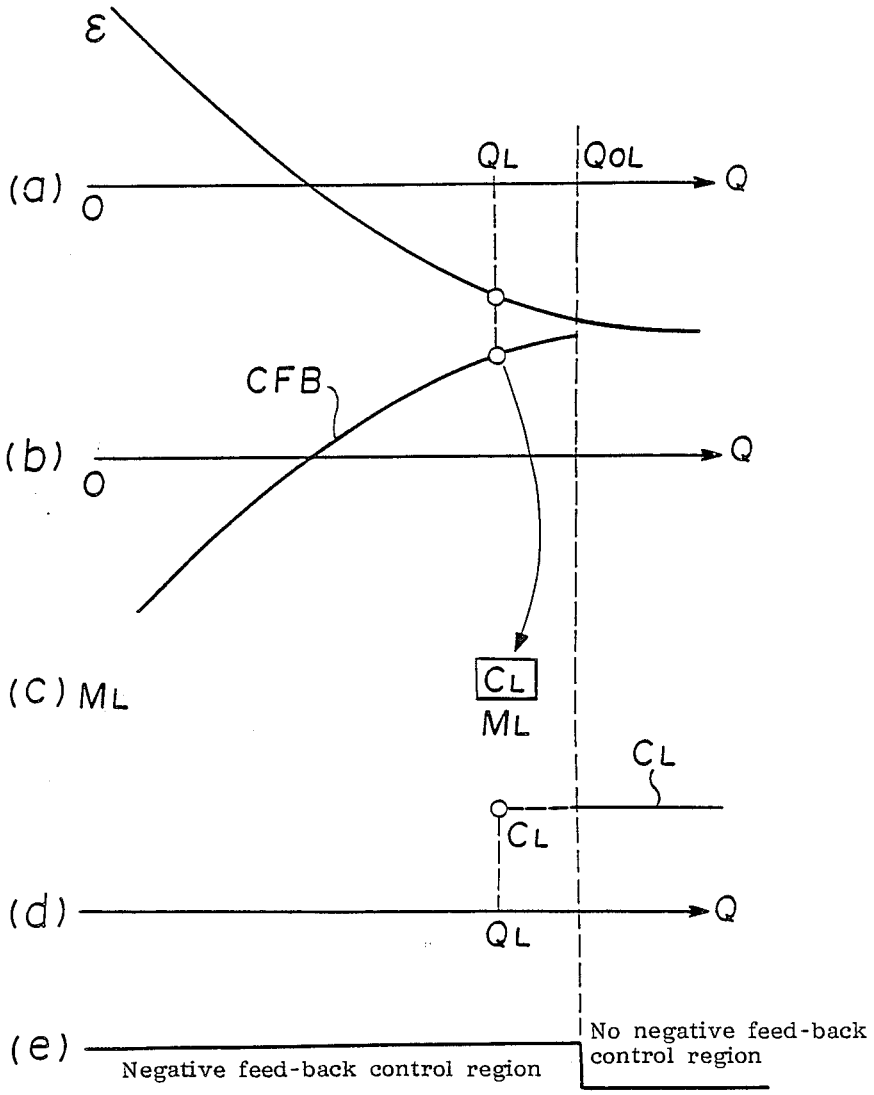
FIG. 4 is a diagram illustrating the change of characteristic of an intake air quantity sensor used for the fuel control apparatus and the operation of the correction of error.

It is preferable that the representative point of flow rate $Q_L$ is in a large flow rate area in the region which allows the negative feed-back correction because it is possible to correct more precisely an error occuring in the region to which the value CL of learning and correction is applicable. When the value CL is applied in a region of flow rate smaller than $Q_L$, an error may take place. Accordingly, it is appropriate that the flow rate Q is only applicable to the region greater than $Q_{OL}$ ($\div Q_L$) as shown in FIG. 4.

In the above-mentioned embodiment, the learning and correction value is applied to the area higher than the flow rate $Q_{OL}$ which provides the border line of use or non-use of the negative feed-back correction. However, the same control as above-mentioned can be obtained by determining a high flow rate region in which the negative feed-back correction is stopped, by using the number of revolution N of the engine and the output Q of the intake air quantity sensor, or the basic injection quantity Q/N.

There is a danger that a sufficient time which provides $Q=Q_L$ can not be maintained when an operational condition of engine varies, and therefore, an appropriate correction value $C_L$ can not be obtained. In consideration of this, it is preferable to increase a chance of obtaining the correction value CL by taking the flow rate Q being approximately equal to $Q_L$ ($Q \div Q_L$) when the representative value is in practically allowable range, i.e. $QL \pm \Delta Q$. However, when a value $\Delta Q$ is two large, there takes place an error to thereby cause scattering in the correction value $C_L$. Accordingly, there is a preferred range of the value $\Delta Q$.

In the above-mentioned embodiment, description has been made as to the fuel control apparatus with a hot wire type intake air quantity sensor. It is because the hot wire type intake air quantity sensor shows a relatively large change of characteristic and flow-rate dependency by materials deposited on the surface of the hot wire as well as operating conditions. However, the method of correction according to the present invention is also applicable to the apparatus with a vane type or the other type intake air quantity sensor which have flow-rate-dependent characteristic.

As to control of gas purged from the canister 20, the determination of mode is carried out at Step S7. The control valve 21 is closed in a specified operating mode (for instance, an idling state), and the valve is opened in the other operating mode. At the time of opening the valve, the purged gas is mixed with intake air. In the region of $Q \div Q_L$ in which learning of the air-fuel ratio negative feed-back quantity CFB takes place, the control valve 21 is forcibly closed at Step S3 to thereby block the mixing of the purged gas with the intake air. Accordingly, good learning and correction is obtainable because there is no adverse affect of the purged gas to a value obtained by the learning and correction.

In the above-mentioned embodiment, purging of gas is prohibited in the region of $Q \div Q_L$. Accordingly, if the operation in this region continues for a long time, there causes imbalance between an amount of fuel catched by the canister and the amount of fuel purged, whereby an excessive amount of fuel is accumulated in the canister. In this case, a treatment that Steps S3 through S6 should be thinned out for an appropriate time when a period of learning S1 in the region of $Q \div Q_L$ reaches a predetermined time.

Thus, in the present invention, an air-fuel ratio negative feed-back quantity is stored in the corresponding memory at or near the flow rate point representing the change of characteristic of an intake air quantity sensor, whereby the basic quantity of fuel control is corrected by using a correction value stored in the memory. Accordingly, excellent control is obtainable even though there takes place a change of characteristic in the intake air quantity sensor.

Since a control valve for purging fuel gas is closed in a period of starting for the negative feed-back correction, there is no effect of an air-fuel ratio error due to the purged gas to the correction value in the memory, an erroneous correction does not take place in a high flow rate region which is not influenced by the purged gas.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel control-apparatus which comprises a fuel supplying means for supplying fuel to an internal combustion engine in response to the operation of a fuel control valve, an intake air quantity sensor disposed in an air intake passage of said internal combustion engine to detect a quantity of intake air, an air-fuel ratio sensor attached to the exhaust pipe of said engine to produce an output in response to an air-fuel ratio and a fuel control means which receives the output of said intake air quantity sensor to calculate a basic value corresponding to an amount of fuel required for said engine, and corrects said basic value by a negative feed-back control on the basis of the output of said air-fuel ratio sensor so as to obtain a desired air-fuel ratio to thereby supply the fuel to said engine by controlling said fuel control valve, wherein said fuel control means comprises a writing means for writing in a memory a value of negative feed-back correction or a value related thereto when the output of said intake air quantity sensor is in the vicinity of a representative point, a correcting means for correcting said basic value on the basis of data in said memory and a valve controlling means to close a control valve which controls feeding of vaporized fuel caught in a canister to the air intake system of said engine when said value of negative feed-back correction or the value related thereto is written in said memory.

2. The fuel control apparatus according to claim 1, wherein said intake air quantity sensor is a hot wire type sensor.

3. The fuel control apparatus according to claim 1, wherein a period for determining the negative feed-back correction, an average value of the negative feed-back correction and values related thereto are written in said memory.

4. The fuel control apparatus according to claim 1, wherein correction of said basic value is effected by an air-fuel ratio negative feed-back quantity (CFB) which is determined to cancel the change of characteristic ($\epsilon$) of said intake air quantity sensor.

5. The fuel control apparatus according to claim 4, wherein said air-fuel ratio negative feed-back quantity (CFB) is calculated to obtain the mean value.

* * * * *